US006889659B2

(12) United States Patent
Magel

(10) Patent No.: US 6,889,659 B2
(45) Date of Patent: May 10, 2005

(54) FUEL INJECTOR WITH PRESSURE BOOSTER AND SERVO VALVE WITH OPTIMIZED CONTROL QUANTITY

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/810,585

(22) Filed: Mar. 29, 2004

(65) Prior Publication Data

US 2004/0195387 A1 Oct. 7, 2004

(30) Foreign Application Priority Data

Apr. 2, 2003 (DE) ..... 103 15 015

(51) Int. Cl.[7] ..... F02M 37/04
(52) U.S. Cl. ..... 123/446; 123/467
(58) Field of Search ..... 123/446, 447, 123/467, 500, 501, 198 D, 506

(56) References Cited

U.S. PATENT DOCUMENTS 5,622,152 A * 4/1997 Ishida ..... 123/446
6,446,603 B1 * 9/2002 Bonse et al. ..... 123/446
6,453,875 B1 * 9/2002 Mahr et al. ..... 123/446
6,513,497 B1 * 2/2003 Mahr et al. ..... 123/447
6,644,282 B2 * 11/2003 Schwarz ..... 123/467
6,752,325 B2 6/2004 Kropp et al.
6,776,138 B2 * 8/2004 Mahr et al. ..... 123/446
2002/0088435 A1 * 7/2002 Kropp et al. ..... 123/446

FOREIGN PATENT DOCUMENTS

DE 100 63 545 C1 8/2002

* cited by examiner

*Primary Examiner*—Carl S. Miller
(74) *Attorney, Agent, or Firm*—Ronald E. Greigg

(57) ABSTRACT

A fuel injector for injecting fuel into a combustion chamber of an internal combustion engine, having a pressure booster in which the piston divides a work chamber, acted upon permanently by fuel via a pressure source, from a pressure-relievable differential pressure chamber. A pressure change in the differential pressure chamber is effected via an actuation of a servo valve. The control chamber of the servo valve can be pressure-relieved via a relief valve and which opens or closes a hydraulic connection of the differential pressure chamber with a return. For closing the servo valve piston, the control chamber can be acted upon by a fuel volume diverted from the differential pressure chamber. The action of fuel on the control chamber is effected via lines that contain throttle restrictions. A pressure relief of the control chamber is effected via a relief valve into a return on the low-pressure side.

10 Claims, 2 Drawing Sheets

FUEL INJECTOR WITH PRESSURE BOOSTER AND SERVO VALVE WITH OPTIMIZED CONTROL QUANTITY

BACKGROUND OF THE INVENTION

1. Field of the Invention

This invention is directed to an improved fuel injector, having a pressure booster, for injecting fuel into an internal combustion engine.

2. Description of the Prior Art

Stroke-controlled fuel injection systems with a high-pressure collection chamber (common rail) are increasingly used for introducing fuel into the combustion chambers of direct-injection internal combustion engines. The advantage of this is that the injection pressure of the fuel into the combustion chambers can be adapted to the engine load and engine speed. For reducing emissions and to attain high specific power levels, a high injection pressure is required. Since the attainable pressure level in high-pressure fuel pumps is limited for reasons of strength, to further increase the pressure in fuel injection systems with a high-pressure collection chamber (common rail), a pressure booster can be used in the fuel injector.

German Patent Disclosure DE 101 23 913 relates to a fuel injection system for internal combustion engines that has a fuel injector which can be supplied from a high-pressure fuel source. A pressure booster device that has a movable pressure booster piston is connected between the fuel injector and the high-pressure source. The pressure booster piston divides a chamber, which can be connected to the high-pressure source, from a high-pressure chamber that can be made to communicate with the fuel injector. By filling a return chamber of the pressure booster with fuel, or evacuating fuel from the return chamber, the fuel pressure in the high-pressure chamber can be varied. The fuel injector has a movable closing piston for opening and closing injection openings. The closing piston protrudes into a closing pressure chamber, so that the closing piston can be acted upon by fuel pressure, to attain a force acting on the closing piston in the closing direction. The closing pressure chamber and the return chamber are formed by a common closing-pressure return chamber, in which all the portions of the chamber communicate permanently with one another for exchanging fuel. A pressure chamber is provided for supplying injection openings with fuel and for acting upon the closing piston with a force acting in the opening direction. A high-pressure chamber communicates with the high-pressure fuel source in such a way that in the high-pressure chamber, aside from pressure fluctuations, at least the fuel pressure of the high-pressure fuel source can be constantly applied. The pressure chamber and the high-pressure chamber are formed by a common injection chamber, and all the portions of the injection chamber communicate permanently with one another for exchanging fuel.

German Patent Disclosure DE 102 47 903.8 relates to a pressure-boosted fuel injection device with a control line embodied on the inside. The fuel injection device communicates with a high-pressure source and includes a multi-part injector body. Received in the injector body is a pressure booster, which can be actuated via a differential pressure chamber and whose pressure booster piston divides a work chamber from the differential pressure chamber. The fuel injection device can be actuated via a switching valve. A pressure change in the differential pressure chamber of the pressure booster is effected via a central control line that extends through the pressure booster piston. The switching valve can be embodied as either a magnet valve or a servohydraulic 3/2-way valve.

OBJECT AND SUMMARY OF THE INVENTION

With the embodiment proposed according to the invention, it becomes possible to control a servo piston of a servo valve with the diversion quantity of fuel from the return chamber of the pressure booster. The quantity of fuel flowing out of the return chamber of the pressure booster must be both depressurized and diverted into the return, so that an injection can be made. With the embodiment of the invention, filling of the control chamber of the servo valve with precisely this quantity of fuel diverted from the return chamber of the pressure booster is possible, so that in the fuel injector configured according to the invention, the servo valve control does not cause any additional loss of fuel quantity.

The valve provided on the fuel injector proposed according to the invention still has no leakage at the servo piston in the state of repose, and as a result the injector efficiency is improved, and in particular the guide lengths of the servo piston can be kept short. In an advantageous version, the servo valve, which contains the servo piston, can be designed as a 3/2-way seat-to-seat valve, in which a sealing seat—to name one example—can be embodied as a flat seat, and a housing comprising multiple housing parts can be employed. Embodying the 3/2-way valve as a 3/2-way seat-to-seat valve offers the opportunity of completely eliminating the problems of sealing and tolerances that occur in slide seals with short overlapping lengths.

The invention will be better understood and further objects and advantages thereof will become more apparent from the ensuing detailed description of preferred embodiments taken in conjunction with the drawings, in which:

DESCRIPTION OF THE PREFERRED EMBODIMENTS

Figure 1:
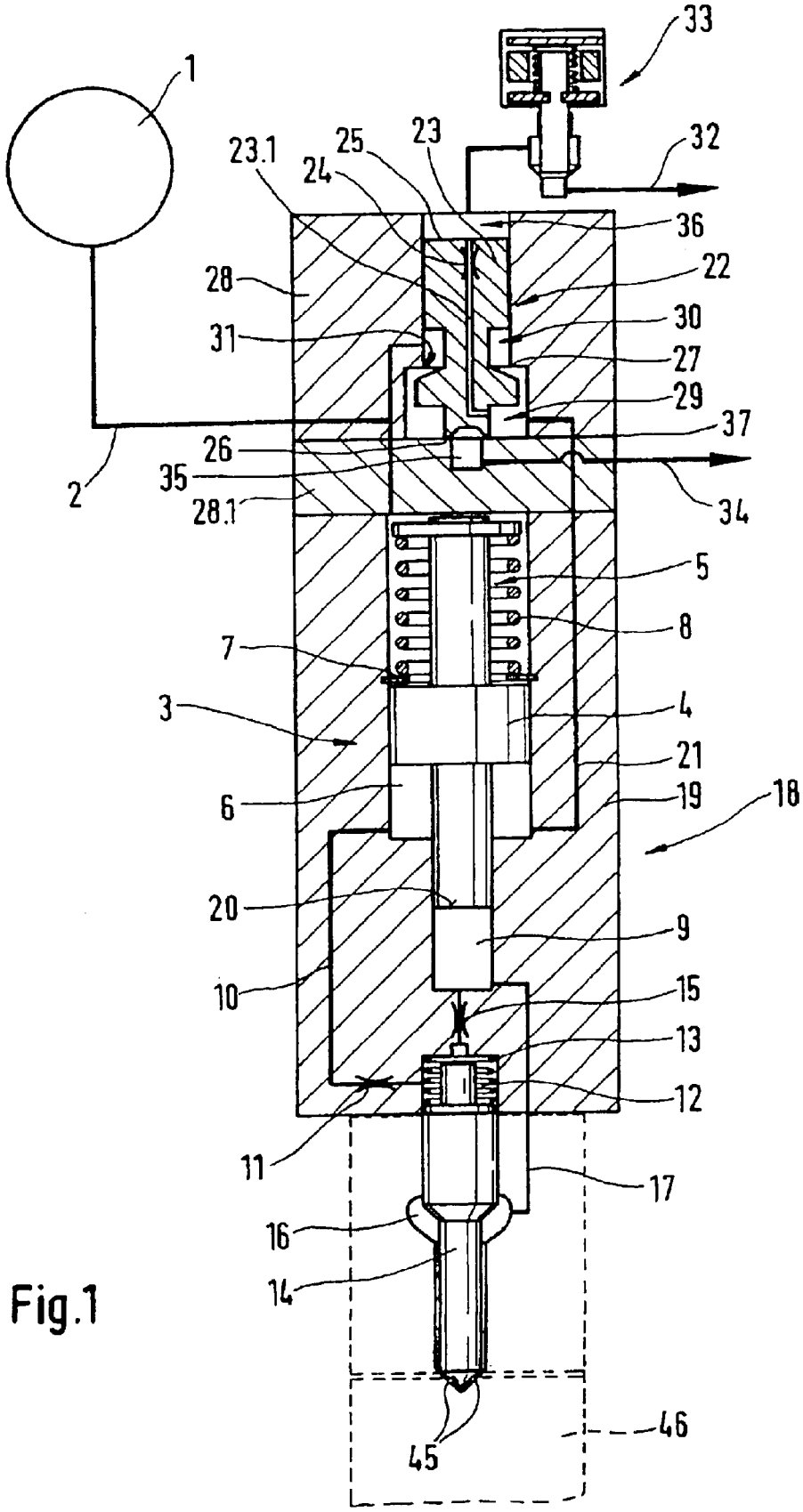
FIG. 1 shows a first exemplary embodiment of a servo valve according to the invention which is assigned to a fuel injector and has a leakage-free servo piston, with control via the return chamber of a pressure booster.

In FIG. 1, an exemplary embodiment of a servo valve with a leakage-free servo piston is shown, which is associated with a fuel injector with a pressure booster; the servo valve is triggered via the return chamber of the pressure booster. The fuel injector 18 shown in FIG. 1 is subjected to fuel that is at high pressure via a high-pressure line 2 that extends from a pressure source 1 embodied as a high-pressure collection chamber. The fuel flowing to the fuel injector 18 via the high-pressure line 2 acts on a work chamber 5 of a pressure booster 3. The work chamber 5 is acted upon permanently by the fuel, which is at high pressure, of the high-pressure source 1. Via a piston 4 of the pressure booster 3, the work chamber 5 is divided from a differential pressure chamber (return chamber) 6. An end face 20 of the pressure booster piston 4 acts upon a compression chamber 9 of the pressure booster 3. The booster piston 4 of the pressure booster 3 is acted upon via a restoring spring 8, which is braced on a support disk 7 that is let into the injector body 19 of the fuel injector 18.

From the differential pressure chamber 6 (return chamber) of the pressure booster 3, an overflow line 10, which contains a first throttle restriction 11, leads to a control chamber 12. Received inside the control chamber 12 for an injection valve member 14 is a spring element 13, which is braced on a boundary wall of the needle control chamber 12 and acts upon a face end of the injection valve member 14. The injection valve member 14 can be embodied as a nozzle needle, for instance. In addition, the compression chamber 9 of the pressure booster 3 and the control chamber 12 communicate with one another via a line that contains a second throttle restriction 15.

The injection valve member 14 is surrounded by a nozzle chamber 16. The injection valve member 14 has a pressure step, which is engaged by the fuel at high pressure flowing into the nozzle chamber 16 when the injection valve member 14 is actuated in the opening direction. The compression chamber 9 of the pressure booster 3 communicates with the nozzle chamber 16 via a nozzle chamber inlet 17 that carries high pressure.

From the differential pressure chamber 6 (return chamber) of the pressure booster 3, a diversion line 21 leads to a servo valve, identified by reference numeral 22. The servo valve 22 is received in a valve body 28 that is located above the fuel injector 18. Via the diversion line 21, fuel diverted from the differential pressure chamber 6 (return chamber) flows into a first hydraulic chamber 29 of the valve body 28. The valve body 28 surrounds a servo valve piston 23, which in the exemplary embodiment shown in FIG. 1 has a through conduit 23.1. Via the through conduit 23.1 that connects the first hydraulic chamber 29 with a control chamber 36, the control chamber 36 of the servo valve 22 is filled with fuel. A pressure relief of the control chamber 36 of the servo valve 22 is effected by actuation of a relief valve 33, indicated here only schematically. From the relief valve 33, a first return 32 leads to a fuel reservoir, not shown in further detail here.

The servo valve piston 23 of the servo valve 22 has a face end 25 which defines the control chamber 36 of the servo valve 22. A throttle restriction 24 is integrated with the through conduit 23.1 of the servo valve piston 23, as shown in FIG. 1.

From the high-pressure line 2 that supplies the work chamber 5 of the pressure booster 3 with fuel that is at high pressure, a branch leads through the valve body 28, and by way of it a second hydraulic chamber 30 of the servo valve 22 is subjected to fuel that is at high pressure. As shown in FIG. 1, a sealing edge 26 is embodied on the underside of the servo valve piston 23 having the through conduit 23.1, and this sealing edge seals off an outflow control chamber 35, which discharges into a second return 34 on the low-pressure side of the fuel injector 18. The servo valve piston 23 furthermore has a portion of mushroom-shaped configuration that cooperates with a sealing edge 27 embodied in the valve body 28 and with it, upon contact, forms a sealing seat 31. Both the sealing edge 26 embodied on the underside of the servo valve piston 23 having the through conduit 23.1 and the sealing edge 27 embodied on the valve body 28 can be embodied as either a flat seat, conical seat, ball seat, or slide edge. In the illustration in FIG. 1, the sealing edge 27 is embodied as a conical seat.

MODE OF OPERATION

In the state of repose of the fuel injector 18, the sealing edge 26 is closed as shown in FIG. 1; that is, the second return 34 is closed. Conversely, in the state of repose the sealing seat 31 is open, and the servo valve body 23 with the through conduit 23.1 is guided in a manner proof against high pressure in the valve body 28 of the servo valve 22; that is, no fuel flows between the control chamber 36 and the second hydraulic chamber 30. Within this guide region, in the state of repose, system pressure prevails both on the side of the control chamber 36 and on the side of the second hydraulic chamber 30, so that no leakage flow to the return occurs. The entire region of the servo piston 23 with the through conduit, that is, the control chamber 36, first and second hydraulic chambers 29 and 30, and the sealing seat 31, is acted upon by system pressure, which is sealed off from the second return 34 in leakage-free fashion by the sealing edge 26 that is moved into its closing position.

In the state of repose, the pressure booster 3, the differential pressure chamber 6 (return chamber), via the opened sealing seat 31, and the high-pressure supply line 2 that discharges into the work chamber 5 are acted upon by system pressure. In this case, the piston 4 of the pressure booster 3 is in pressure equilibrium, and no pressure boosting occurs.

For triggering the pressure booster 3, the differential pressure chamber 6 (return chamber) of the pressure booster 3 is pressure-relieved. For the pressure relief, first the relief valve 33 is activated, that is, opened; as a result, the control chamber 36 that actuates the servo valve 22 is pressure-relieved into the first return 32. The servo valve piston 23 with the through conduit moves upward as a result of the pressure force that engages the underside of the mushroom-shaped portion in the first hydraulic chamber 29 and thus opens the sealing edge 26, while conversely the sealing seat 31 is closed. The sealing edge 26 or the second return 34 or both are designed such that even in the opened state, a slight residual pressure is preserved in the first hydraulic chamber 29, thus assuring that the servo valve piston 23 will remain in its open position and that the sealing seat 31 will remain securely closed. The control flow that flows out via the relief valve 33 into the first return 32 and via the throttle restriction 24 and the open sealing edge 26 into the second return 34 is not a lost quantity, since it is taken from the differential pressure chamber 6 (return chamber) of the pressure booster 3, and this quantity flows to the second return 34 via the sealing edge 26 every time the pressure booster 3 is activated.

When the servo valve piston 23 with the through conduit is open, the differential pressure chamber of the pressure booster is disconnected from the pressure level prevailing in the high-pressure source 1. A pressure relief of the differential pressure chamber 6 (return chamber) takes place via the diversion line 21 into the second return 34. The pressure in the compression chamber 9 is raised in accordance with the inward motion of the end face 20 of the booster piston 4, as a function of the boosting ratio of the pressure booster 3, and via the nozzle chamber inlet 17, it is delivered to injection openings 45 into the combustion chamber 46 of an internal combustion engine. Because of the pressure step embodied on the injection valve member 14, the injection valve member 14 opens when pressure is exerted on the nozzle chamber 16 and uncovers the injection openings 45, and the injection begins. When the injection valve member 14 is completely open, the line that contains the compression chamber 9 and the needle control chamber 12 and a second throttle restriction 15 is closed, so that during the injection event, no lost flow occurs. For damping the opening speed of the injection valve member 14, a separate damping piston can be used. Filling of the compression chamber 9 can be alternatively effected via a check valve, instead of via a line that contains a second throttle restriction 15.

For terminating the injection event, the relief valve 33 is closed. By an overflow of fuel from the first hydraulic chamber 29 via the through conduit 23.1 of the servo valve piston 23, the pressure level prevailing in the first hydraulic chamber 29 builds up in the control chamber 36. Since by design a residual pressure level remains in the first hydraulic chamber 29, a pressure force acting in the closing direction and generated in the control chamber 36 is established, which acts upon the face end 25 of the servo valve piston 23 having the through conduit 23.1. The servo valve piston 23 with the through conduit 23.1 moves downward into its outset position, whereupon the sealing edge 26 is returned to its closing position relative to the outflow control chamber 35, and the sealing seat 31 on the valve body 28 of the servo valve 22 is opened again. To reinforce the motion of the servo valve piston 23 with the through conduit 23.1, it is entirely possible for additional spring elements, which however are not shown in FIG. 1 to be received in the valve body 28 of the servo valve 22.

In the work chamber 5 of the pressure booster 3 and in the control chamber 36 of the servo valve 22, a pressure buildup takes place via the open sealing seat 31, to the pressure level prevailing in the high-pressure source 1. Because of this, the pressure in the compression chamber 9 of the pressure booster 3 and thereupon the pressure prevailing in the nozzle chamber 16 both drop, so that the spring 13 disposed in the control chamber 12 moves the injection valve member 14 into its closing position, and the injection openings 45 that discharge into the combustion chamber 46 of the self-igniting engine are closed.

The sealing edge 26 of the servo valve piston 23 and the sealing edge 27, acting as the sealing seat 31, embodied on the valve body 28 can be embodied in manifold ways. Combinations of a flat seat, conical seat, ball seat or slide edges can be achieved. In order to design both the sealing edge 26 and the sealing edge 27 embodied in the valve body 28 as sealing seats, the valve body 28 is constructed in multiple parts, for instance in two parts, these being the components 28 and 28.1. If the sealing edge 26 is embodied as a flat seat, for instance, then production tolerances in terms of an axial offset of the two valve body components 28 and 28.1 can very easily be compensated for. The sealing edge 26 is acted upon by a strong hydraulic sealing force, generated in the control chamber 36 of the servo valve 22, so that tightness of the sealing edge 26, which seals off the outflow control chamber 35 from the second return 34, at the production precision levels that are attainable at present, is assured even for fuel at extremely high pressure.

Figure 2:
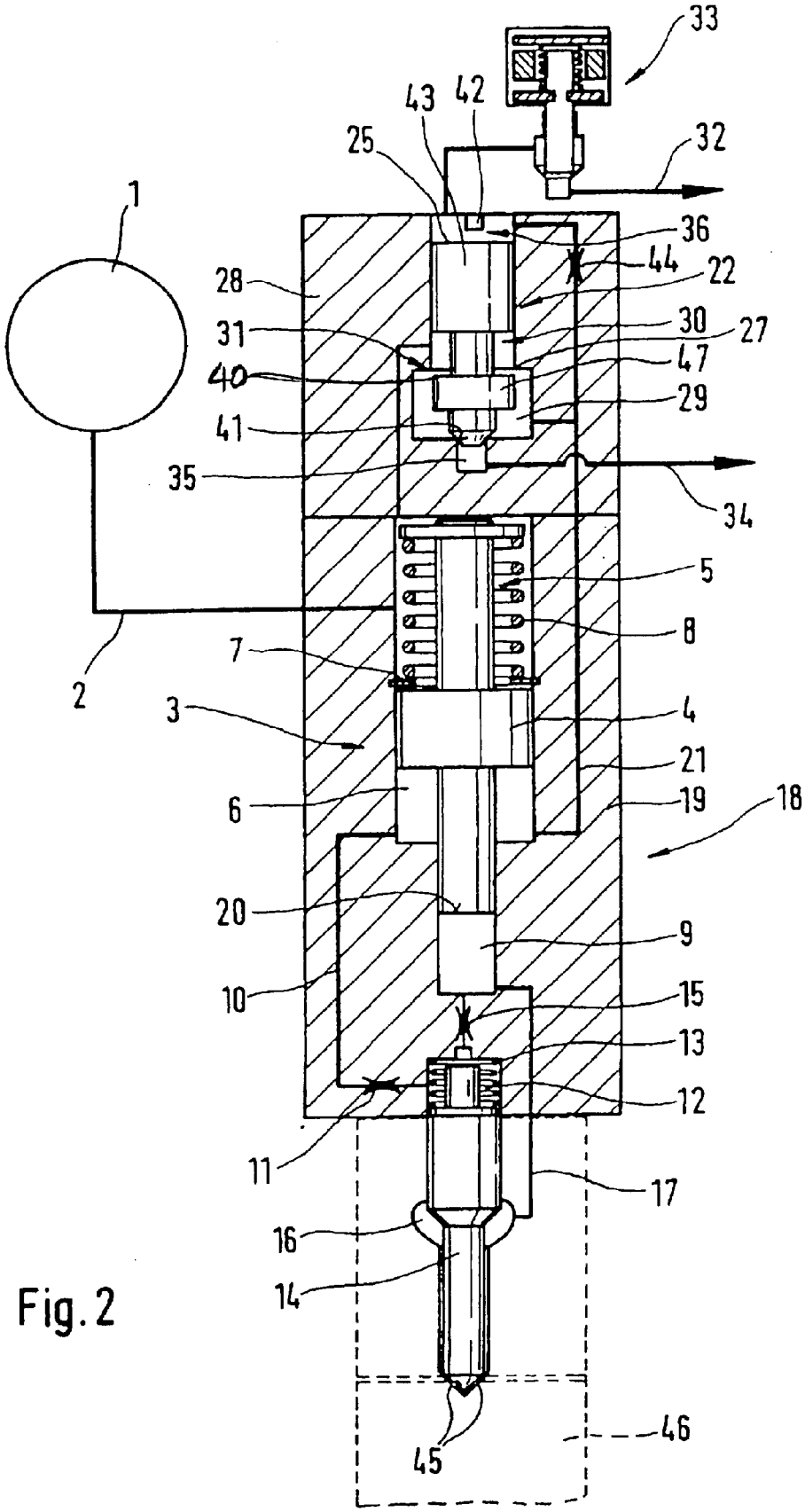
FIG. 2 shows a further exemplary embodiment of the servo valve proposed according to the invention, with a conical sealing seat.

From the exemplary embodiment shown in FIG. 2, a servo valve piston of a servo valve can be seen, whose sealing edge on the low-pressure side is embodied as a conical seat. In contrast to the exemplary embodiment shown in FIG. 1, of a fuel injector 18 with a servo valve 22, which includes a servo valve piston 23 with a through conduit 23.1, in the illustration in FIG. 2 the servo valve piston 43 of the servo valve 22 is embodied without such a through conduit 23.1. Moreover, the valve body 28 that receives the servo valve 22 is embodied in one piece. To facilitate assembly, the servo valve piston 43 in the exemplary embodiment shown in FIG. 2 has a slide portion 47, which is embodied with the same diameter as the head region of the servo valve piston 43, whose face end 25 defines the control chamber 36 of the servo valve 22. In a distinction from what is shown in FIG. 1 filling of the control chamber 36 is effected via a separate line, branching off from the diversion line 21, that contains a throttle restriction 44 toward the valve housing.

The slide portion 47 is embodied with an axial length adapted to the servo valve piston 43 such as to enable an overlap of the slide edge 40, embodied in the one-piece valve body 28 of the servo valve 22, upon closure. Besides a slide seal edge 40, a sealing face can also be embodied here. The sealing force on the servo piston 43 is adjusted via a pressure face facing the diversion chamber 35. When a sealing face is used, an optimal layout of the pressure per unit of surface area is possible, and as a result both adequate tightness and low wear can be attained. In a distinction from the servo valve piston 23 with the through conduit of FIG. 1, a sealing edge 41 that closes the outlet of the diversion chamber 35 to the second return 34 is embodied as a conical sealing seat. The mode of operation of the servo valve 22 in the second exemplary embodiment of FIG. 2 is equivalent to that of the fuel injector 18 and the servo valve 22 that have already been described in conjunction with FIG. 1. The relief valve 33 for relieving the pressure of the control chamber 36 of the servo valve 22 can be embodied as a 2/2-way valve or as a 3/2-way valve. Besides the variant embodiment as a magnet valve shown in FIG. 2, the relief valve 33 can also be embodied as a piezoelectric actuator.

Upon pressure relief of the differential pressure chamber 6 (return chamber) of the pressure booster 3, in the exemplary embodiment shown in FIG. 1 an overflow of fuel takes place via the diversion line 21 into the first hydraulic chamber 29, and from there, via the through conduit embodied in the servo valve piston 23, filling of the control chamber 36 of the servo valve takes place. In the exemplary embodiment shown in FIG. 2, upon pressure relief of the differential pressure chamber 6 (return chamber) of the pressure booster 3, filling of the first hydraulic chamber 29 and of the control chamber 36, containing a stop 42 for the face end 25 of the servo valve piston 43, takes place in parallel, via two line segments branching off from the diversion line 21. In the exemplary embodiment of FIG. 1, a throttle restriction 24 is provided in the through conduit of the servo valve piston 23, and in the exemplary embodiment of FIG. 2 a throttle restriction 44 toward the valve body is likewise disposed in the line segment by way of which the control chamber 36 of the servo valve 22 is filled. The pressure relief of the control chamber 36 of the servo valve 22 takes place analogously to FIG. 1, via an actuation of the switching valve 33 and a diversion of a control quantity from the control chamber 36 into the first return 32.

In the exemplary embodiment shown in FIG. 2, the high-pressure supply line 2 extending from the high-pressure source 1 (common rail) into the work chamber 5 of the pressure booster 3 discharges directly into the work chamber 5 of the pressure booster 3. From there, a line branches off that enables filling of the second hydraulic chamber 30 of the servo valve 22. The construction of the fuel injector 18 with regard to the components contained in the injector body 19 is equivalent to the construction that has already been described in conjunction with the first exemplary embodiment of the fuel injector 18 according to the invention, and its valve body 19.

Instead of the conical sealing seat 41, shown in the exemplary embodiment of FIG. 2, on the underside of the servo valve piston 43, it is readily possible to embody this seat as a flat seat, ball seat, or slide edge, depending on the sealing tolerances attainable by the production technology employed. The sealing force acting on the sealing edge 26 (of FIG. 1) or the conical sealing seat 41 (of FIG. 2) is adjusted by way of the pressure level generated in the control chamber 36 of the servo valve 22. The higher this pressure level, the higher the pressure force is that is established above the outflow control chamber 36 in the direction of the second return 34.

The foregoing relates to preferred exemplary embodiments of the invention, it being understood that other variants and embodiments thereof are possible within the spirit and scope of the invention, the latter being defined by the appended claims.

I claim:

1. In a fuel injector for injecting fuel into a combustion chamber (46) of an internal combustion engine, including a pressure booster (3) whose booster piston (4) divides a work chamber (5), acted upon permanently by fuel via a pressure source (1, 2), from a pressure-relievable differential pressure chamber (6), wherein a pressure change in the differential pressure chamber (6) is effected via an actuation of a servo valve (22) whose control chamber (36) can be pressure-relieved via a relief valve (33) and which opens or closes a hydraulic connection (21, 29, 35) of the differential pressure chamber (6) with a return (34), the improvement wherein, for closing the servo valve piston (23, 43), the control chamber (36) acted is upon by a fuel volume diverted from the differential pressure chamber (6), and its being acted upon by fuel is effected via at least one line (23.1, 21) that contains a throttle restriction (24, 44), and its pressure relief is effected via a relief valve (33) into a return (32) on the low-pressure side.

2. The fuel injector in accordance with claim 1, wherein the servo valve piston (23) comprises a sealing edge (26) for closing or opening the connection of the differential pressure chamber (6) with the return (34).

3. The fuel injector in accordance with claim 1, wherein the servo valve piston (23, 43) comprises a control edge for controlling the hydraulic connection of the differential pressure chamber (6) with the pressure source (1, 2).

4. The fuel injector in accordance with claim 1, wherein the servo valve piston (23) of the servo valve (22) comprises a through conduit (23.1), by way of which fuel diverted from the differential pressure chamber (6) flows to the control chamber (36) via a first hydraulic chamber (29).

5. The fuel injector in accordance with claim 1, wherein both the control chamber (36) of the servo valve (22) and a first hydraulic chamber (29) are acted upon in parallel with fuel via line portions supplied from the diversion line (21).

6. The fuel injector in accordance with claim 1, wherein the servo valve (22) comprises a second hydraulic chamber (30), which is acted upon via the high-pressure line (2), communicating with the pressure source (1), by fuel that is at high pressure.

7. The fuel injector in accordance with claim 6, wherein the second hydraulic chamber (30) can be closed by means of a sealing seat (31) on the servo valve piston (23, 43), and wherein the sealing seat (31) is embodied as a conical seat, a slide seal (27, 47), or a flat seat (37).

8. The fuel injector in accordance with claim 1, wherein the servo valve piston (23, 43) of the servo valve (22) comprises a seal which seals off the first hydraulic chamber (29) from the return (34) and can be embodied as a conical seat (41) or a flat seat (37).

9. The fuel injector in accordance with claim 8, further comprising a spring applying a spring force to the servo valve piston (23, 43) to reinforce the sealing action at the sealing point.

10. The fuel injector in accordance with claim 1, wherein the servo valve piston (23, 43) is received in a multi-part valve body (28, 28.1) of the servo valve (22).

* * * * *